US009056346B2

(12) United States Patent
Bonnen et al.

(10) Patent No.: US 9,056,346 B2
(45) Date of Patent: Jun. 16, 2015

(54) ELECTRODE ASSEMBLY FOR ELECTRO-HYDRAULIC FORMING PROCESS

(71) Applicant: Ford Global Technologies, LLC, Dearborn, MI (US)

(72) Inventors: John Joseph Francis Bonnen, Milford, MI (US); Sergey Fedorovich Golovashchenko, Beverly Hills, MI (US); Scott Alwyn Dawson, Rochester, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 14/101,785

(22) Filed: Dec. 10, 2013

(65) Prior Publication Data

US 2014/0083151 A1 Mar. 27, 2014

Related U.S. Application Data

(62) Division of application No. 12/940,235, filed on Nov. 5, 2010, now Pat. No. 8,667,824.

(51) Int. Cl.

| | |
|---|---|
| ***B21D 26/12*** | (2006.01) |
| ***B21D 26/10*** | (2006.01) |
| ***B21D 31/04*** | (2006.01) |

(52) U.S. Cl.

CPC ..... *B21D 26/12* (2013.01); *Y10T 29/49805* (2015.01); *B21D 26/10* (2013.01); *B21D 31/04* (2013.01)

(58) Field of Classification Search

USPC ..... 72/54, 56, 61, 62; 601/4; 367/147; 29/419.2, 421.1, 421.2; 313/141, 143, 313/144, 145, 118

See application file for complete search history.

(56) References Cited

U.S. PATENT DOCUMENTS

| | | | | |
|---|---|---|---|---|
| 1,815,714 | A * | 7/1931 | Hurley | 313/137 |
| 3,222,902 | A | 12/1965 | Brejcha et al. | |
| 3,267,710 | A | 8/1966 | Inoue | |
| 3,358,487 | A | 12/1967 | Brejcha et al. | |

(Continued)

FOREIGN PATENT DOCUMENTS

| | | |
|---|---|---|
| GB | 1193200 | 5/1970 |
| JP | 201552234 U | 8/2010 |

OTHER PUBLICATIONS

U.S. National Library of Medicine, National Institute of Health, PubMed, The Influence of electrode shape on the performance of electrohydraulic lithotripters, J. Stone Dis. 1993, Loske AM, Prieto FE.

(Continued)

*Primary Examiner* — Shelley Self
*Assistant Examiner* — Mohammad I Yusuf
(74) *Attorney, Agent, or Firm* — Damian Porcari; Brooks Kushman P.C.

(57) ABSTRACT

An electrode assembly for electro-hydraulic forming tool in which the insulation sleeve is assembled over an electrode rod. The insulation sleeve has a deflection surface that is beveled or oriented at an angle relative to the axis of the electrode rod. The electrode assembly may include a replaceable conical receptacle that facilitates placement of an electrode tip an insulation sleeve tip. An electrode tip profile that is shaped to minimize erosion caused by discharge of the electro-hydraulic forming machine.

11 Claims, 6 Drawing Sheets

(56) References Cited

U.S. PATENT DOCUMENTS

| | | | | | |
|---|---|---|---|---|---|
| 3,408,432 | A | * | 10/1968 | Guin et al. | 72/56 |
| 3,438,125 | A | | 4/1969 | Larsen et al. | |
| 3,491,564 | A | | 1/1970 | Hundley et al. | |
| 3,572,072 | A | | 3/1971 | Hundley et al. | |
| 3,673,833 | A | | 7/1972 | Cadwell | |
| 3,688,535 | A | | 9/1972 | Keinanen et al. | |
| 3,700,169 | A | | 10/1972 | Naydan et al. | |
| 5,091,672 | A | | 2/1992 | Below | |
| 5,128,583 | A | * | 7/1992 | Ma | 313/137 |
| 5,208,788 | A | | 5/1993 | Dancer et al. | |
| 5,420,473 | A | | 5/1995 | Thomas | |
| 5,477,104 | A | * | 12/1995 | Tanabe et al. | 313/137 |
| 6,094,809 | A | | 8/2000 | Grassi | |
| 6,217,531 | B1 | | 4/2001 | Reitmajer | |
| 6,285,008 | B1 | * | 9/2001 | Fleetwood et al. | 313/141 |
| 6,819,033 | B2 | * | 11/2004 | Kanao et al. | 313/141 |
| 7,390,308 | B2 | | 6/2008 | Schultheiss | |
| 7,493,787 | B2 | | 2/2009 | Golovashchenko et al. | |
| 7,516,634 | B1 | | 4/2009 | Golovashchenko et al. | |
| 7,714,490 | B2 | * | 5/2010 | Takada | 313/141 |
| 7,802,457 | B2 | | 9/2010 | Golovashchenko et al. | |
| 8,536,770 | B2 | * | 9/2013 | Kameda et al. | 313/141 |

OTHER PUBLICATIONS

Sciencedirect—Thin Solid Films; Needle electrode erosion in water plasma discharge, S. Potocky, N. Saito, and O. Takai, Tokyo 102-0075, Japan, Available online Aug. 5, 2009, Hybrid Materials 2011, Mar. 6-10, 2011—Strasbourg, France, Second International Conference on Multifunctional, Hybrid and Nanomaterials.

Design and Fabrication of a Shock Wave Generator for Musculoskeletal Disorders, vol. 18, No. 1, Feb. 2006, Shen-Min Liang, Kiet-Houng Chow, Ioannis Manousaka, Yong-Ren Pu, Chien-Chen Chang.

Chinese Office Action dated Sep. 19, 2014.

* cited by examiner

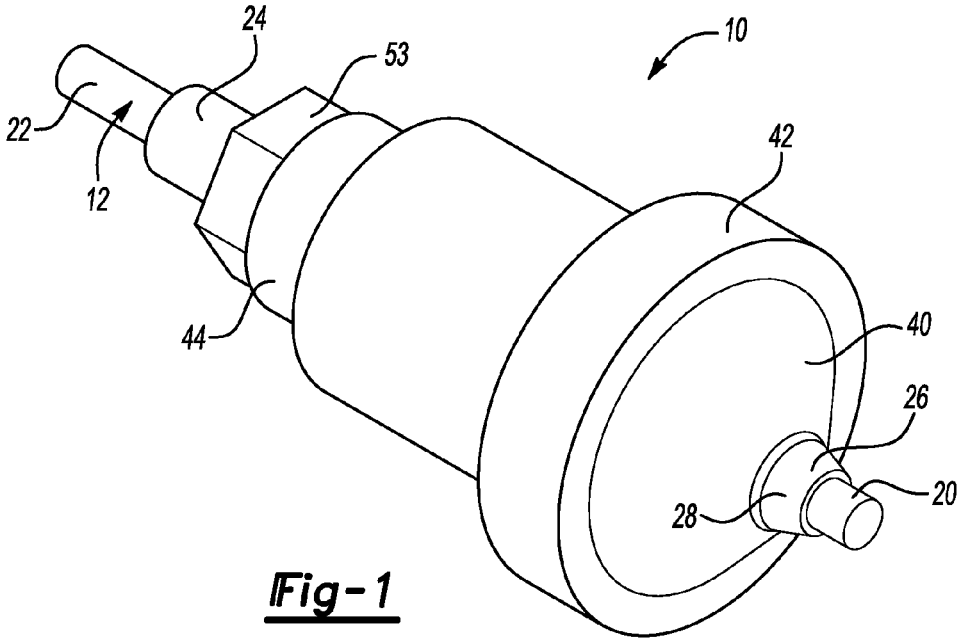
Fig-1
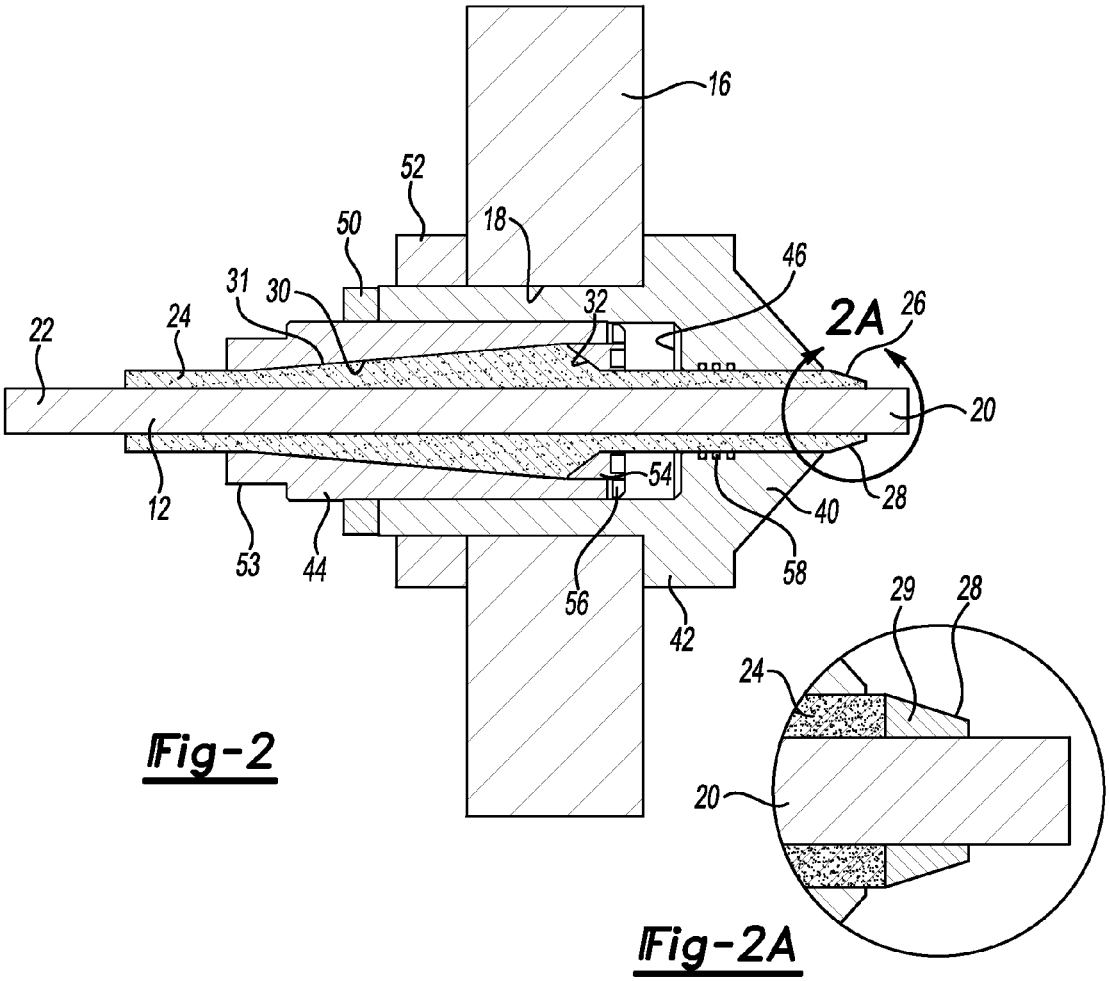
Fig-2
Fig-2A

ELECTRODE ASSEMBLY FOR ELECTRO-HYDRAULIC FORMING PROCESS

CROSS REFERENCE TO RELATED APPLICATION

This application is a division of U.S. application Ser. No. 12/940,235 filed Nov. 5, 2010, the disclosure of which is hereby incorporated in its entirety by reference herein.

BACKGROUND

1. Technical Field

The present invention relates to the structure and operation of electrode assemblies for electro-hydraulic forming processes.

2. Background

Electro-hydraulic forming (EHF) is a process in which a high voltage, stored charge is discharged across spaced electrodes that are disposed in a fluid filled chamber. An EHF system generally includes a chamber that is filled with fluid, for example water with a rust preventative. The electrodes are immersed in the fluid within the chamber. A sheet metal blank is placed on the chamber. A one-sided die is then placed on the blank. Air is then evacuated from both sides of the blank. The capacitor bank stores a charge and may provide between 5 to 50 kV through the electrodes.

The voltage applied to the electrodes creates a high temperature plasma channel. Current from the capacitors expands the plasma channel and fills the region surrounding the plasma channel with gas in the form of super heated steam which then transitions to a steam/water interface. Pressure builds within the chamber and results in a high intensity high velocity shock wave being formed in the liquid that is transmitted to the sheet metal blank. The sheet metal blank is driven into the die by the high velocity shock wave.

Traditional advantages over conventional sheet metal forming processes that are known include reduction in capital cost because only a one-sided die is required to form a panel. Recently, EHF processes have been proposed for forming sheet metal materials that are more difficult to form than low carbon steel. For example, the EHF process could be used to manufacture automotive and truck components from high strength steel, stainless steel or aluminum alloys. EHF processes are generally targeted at low volume stamping processes that may take advantage of the savings resulting from the use of a one-sided die.

The electrode assembly is subject to erosion caused by the shock wave and high temperature plasma. In addition, the fluid in the chamber tends to be corrosive. These conditions lead to erosion of both electrodes and insulation that fills the gap between the chamber and the electrodes. The shock wave resulting from discharge of the capacitors through the electrodes exerts a force on the electrode assembly tending to expel the electrode and insulation from the chamber. The electrode system must withstand the high pressure and high temperature plasma, as well as the corrosive water in the chamber. The electrodes must conduct energy into the chamber, maintain electrical isolation through the insulation, maintain the chamber in a water tight condition and constrain electrode motion during pressure pulses tending to eject the electrode from the chamber.

These and other problems are addressed in applicants' development as summarized below.

SUMMARY

Applicants' development, as summarized below, is directed to providing a robust electrode assembly for the EHF forming that resists erosion of the electrode, erosion of the insulation material, expulsion of the electrode or its insulation from the chamber. The electrode assembly must also be adjustable to assure maintenance of the desired inter-electrode gap. In addition, the disclosure also provides for a renewable replaceable electrode tip and ways to reduce erosion and wear of the insulation.

According to one aspect of the present development, an electrode assembly for an electro-hydraulic forming tool that has a fluid filled chamber is provided. The electrode assembly includes an electrode rod upon which an insulation sleeve is assembled. The insulation sleeve has a chamber end and a connector end. The insulation sleeve has a deflection surface at the chamber end that forms a frustum of cone between the electrode rod and the chamber. The deflection surface is narrowest near the electrode to deflect the force of a discharge of the electro-hydraulic forming tool.

According to other aspects of the invention, the deflection surface may be formed as a tapered part of the insulation sleeve on the inner end of the insulation sleeve. Alternatively, the deflection surface may be formed on a metal cap that is assembled over the electrode rod and against the inner end of the insulation sleeve.

According to other aspects of the invention relating to providing an adaptor, an adaptor may be disposed about the insulator sleeve that secures electrode and the insulation sleeve in an opening defined by the chamber. A holder may be provided that receives the electrode and insulation sleeve that is in turn received within the adaptor.

The insulator sleeve may have a reaction surface disposed between the chamber end and the connector end. The reaction surface may be partially conical in shape with its narrowest end at the end of the reaction surface that is furthest from the chamber end of the insulation sleeve. The adaptor may be disposed about the insulation sleeve to secure the electrode and the insulation sleeve in an opening defined by the chamber. A holder may be provided that receives the electrode and insulation sleeve and that is received within the adaptor. The holder may have a conical force receiving surface that is engaged by a reaction surface to hold the insulation sleeve within the holder. A retainer may be attached to the holder to secure the insulation sleeve and the electrode rod within the holder. A lock ring may be provided that locks the retainer to the holder.

According to another aspect of the disclosure, an electrode assembly may be provided for an electro-hydraulic forming tool that has a chamber. The electrode assembly may comprise an electrode rod, an insulation sleeve assembled over the electrode rod with the sleeve having an inner end that is closest to the chamber than the outer end. An adaptor may be disposed about the insulation sleeve to secure the electrode in the insulation sleeve in an opening defined by the chamber.

A conical receptacle may be assembled to the adaptor that defines an opening. A replaceable insulator tip may be assembled within the opening in the conical receptacle. The chamber end of the insulation sleeve may be received within the insulator tip. The conical receptacle may retain the insulator tip when the electrode assembly is discharged and the conical receptacle is removed from the adaptor to replace the insulator tip.

According to other aspects of the invention as they relate to an electrode assembly having a replaceable insulator tip, the adaptor may define the cup-shaped end that is disposed within the chamber. The conical receptacle may be at least partially received within the cup-shaped end of the adaptor.

A holder may be provided that receives the electrode and the insulation sleeve. A retainer may be attached to the holder to secure the insulation sleeve and the electrode rod within the holder. A lock ring may be provided that locks the retainer to the holder.

According to another aspect of the disclosure, an electrode assembly for an electro-hydraulic forming tool may be provided. The tool has a chamber that receives an electrode rod that extends from outside of the chamber to inside the chamber. The electrode rod may be provided with a main portion and a tip. An insulation sleeve is preferably assembled over the electrode rod with the insulation sleeve having a chamber end and a connector end. A holder attaches the electrode rod and insulation sleeve to the chamber.

Other aspects of the disclosure relate to providing a tip portion that is formed with different material than the main portion of the electrode rod with the tip portion being welded to the main portion. The tip portion may be selected from a more erosion resistant and durable material such as low carbon steel, tungsten, molybdenum, or a tungsten-copper alloy. The main portion may be selected from the group consisting essentially of low carbon steel. The tip portion may have a tip profile that is a flat tip with rounded edges that conform to the shape of a cylindrical electrode after a substantial number of pulses.

These and other aspects of the present invention would be better understood with the attached drawings and the following detained description of the illustrated embodiments.

BRIEF DESCRIPTION OF THE DRAWINGS

FIG. 1 is a perspective view of an electrode assembly for an electro-hydraulic forming tool made according to one embodiment of the disclosure;

FIG. 2 is a cross section of an electrode assembly assembled to an electro-hydraulic forming tool shown in FIG. 1;

FIG. 2A is a fragmentary cross-section of an alternative embodiment of the electrode tip and insulation sleeve with a tip cap;

DETAILED DESCRIPTION

Figure 3:
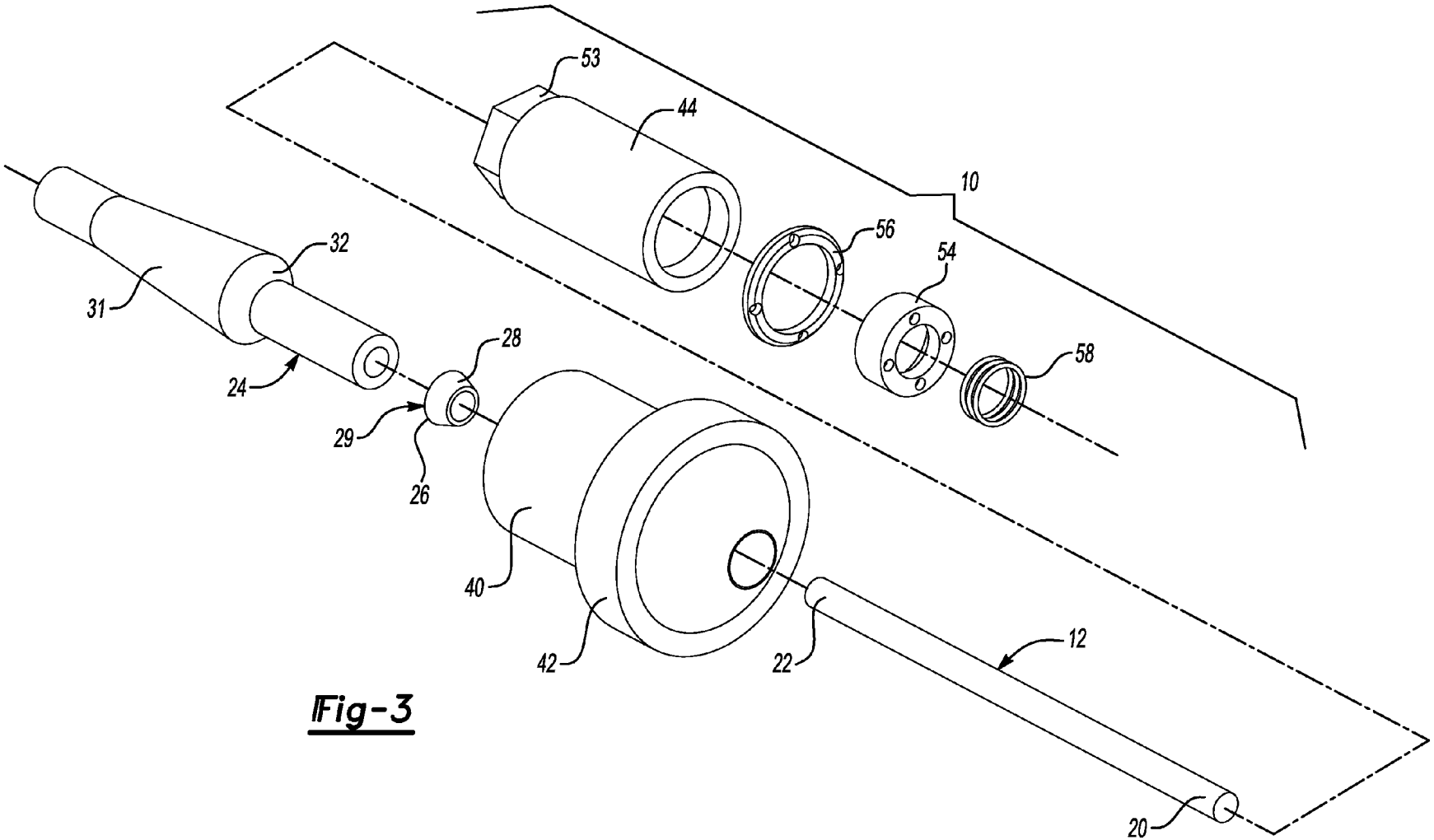
FIG. 3 is an exploded perspective of the electrode assembly shown in FIG. 1.
Figure 4:
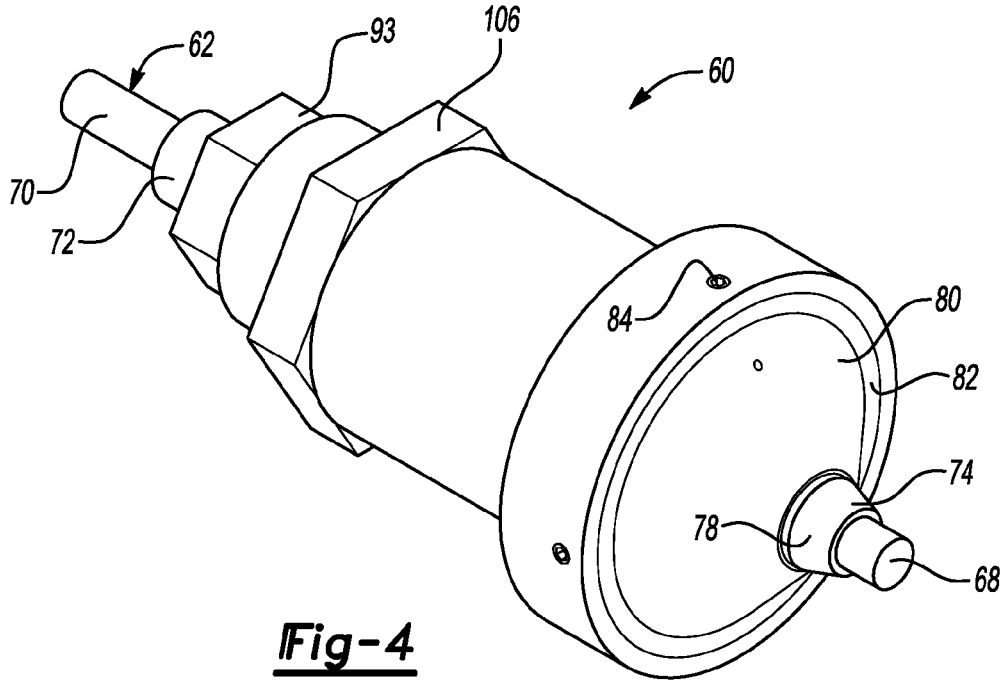
FIG. 4 is an alternative embodiment of an electrode assembly for an electro-hydraulic forming tool.

Referring to FIGS. 1-3, an electrode assembly 10 is shown that includes an electrode rod 12. As shown specifically in FIG. 2, the electrode assembly 10 is assembled to an electro-hydraulic forming (EHF) chamber wall 16. The chamber wall 16 defines an opening 18 in which the electrode assembly 10 is received. The electrode assembly 10 has a chamber end 20 that is disposed within the EHF chamber and a connector end 22 that extends outboard of the EHF chamber wall 16, and is adapted to be connected to an electrical connector. The electrical connector connects the electrode assembly 10 to a source of stored charge such as a bank of capacitors.

An insulation sleeve 24 has an insulation tip 26 on the side of the insulation sleeve 24 adjacent the chamber end 20 of the electrode rod 12. A deflection surface 28 is formed on the insulation tip 26 to deflect the force of an electro-hydraulic discharge from directly impacting the insulation sleeve 24. The deflection surface 28 may be bevelled or formed as a frustum of a cone.

Alternatively, and as shown in FIG. 2A, a metal cap 29 may be provided that is assembled to the chamber end of the electrode rod chamber end 20 and insulation sleeve 24. In this arrangement, the deflection surface 28 would be provided on the cap 29 to deflect the force of an electro-hydraulic discharge from directly impacting the insulation sleeve 24.

A reaction surface 30 distributes any force applied to the insulation sleeve 24 by the electro-hydraulic discharge to the other parts of the electrode assembly 10, as will be more fully described below. A locking surface 32 is also provided on the insulation sleeve 24 that is provided to lock the insulation sleeve 24 in place within the electrode assembly 10.

An adaptor 40 may be provided between the chamber end 20 of the electrode rod 12 and the insulation sleeve 24 and the chamber wall 16. The adaptor preferably includes a bevelled or a frustoconical surface that extends to a shoulder 42. The shoulder 42 is placed into direct contact with the EHF chamber wall 16. The shoulder 42 is assembled against the EHF chamber wall 16.

A holder 44, as best shown in FIG. 2, is provided within the adaptor 40 to hold the insulation sleeve 24 in place within the adaptor 40. A holder receptacle 46 is defined within the adaptor 40 and comprises an opening in the adaptor 40 in which the holder 44 is assembled. An adaptor nut 52 is provided to secure the adaptor 40 to the chamber wall 16. A holder nut 50 is provided to secure the holder 44 within the adaptor 40. A plurality of o-rings 58 may be provided to provide a seal between the insulation sleeve 24 and the adaptor 40.

A retainer 54 holds the insulation sleeve 24 within the holder 44. The retainer 54 and locking ring 56 combine to hold the insulation sleeve 24 against the holder 44. The holder 44, as shown in FIG. 2, has a plurality of wrench flats 53 that are intended to be turned by a wrench to advance and retract the holder 44 within the holder receptacle 46. The holder 44 is advanced and retracted to move the electrode rod 12 and insulation sleeve 24 relative to the EHF chamber 16. The holder 44 is threaded to facilitate advancement of the electrode rod 12 through the chamber wall 16. The electrode rod 12 is threaded to facilitate electrical connection to the connector end 22 and to mechanically interlock the insulation sleeve 24 and the electrode rod 12. Clearance space is provided between the locking ring 56 and the end of the holder receptacle 46 to allow for adjustment of the electrode rod 12 to its desired position within the EHF chamber 16.

Figure 5:
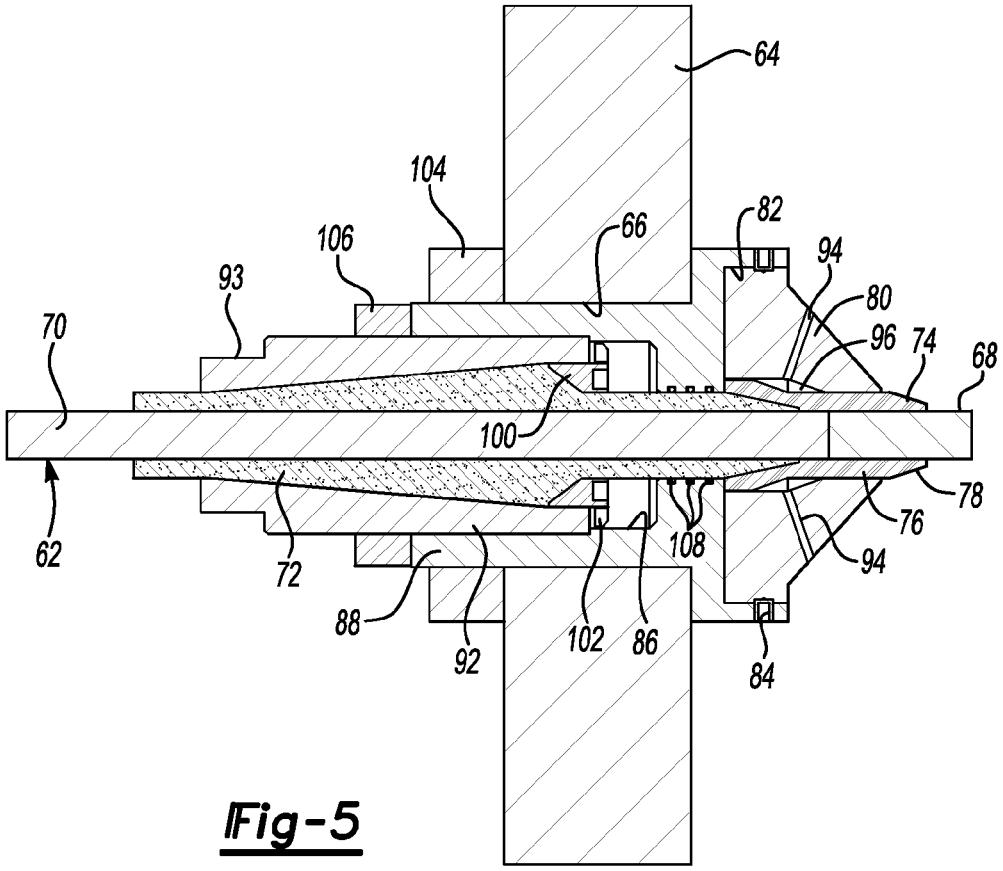
FIG. 5 is a cross sectional view of the embodiment of the electrode assembly shown in FIG. 4.
Figure 6:
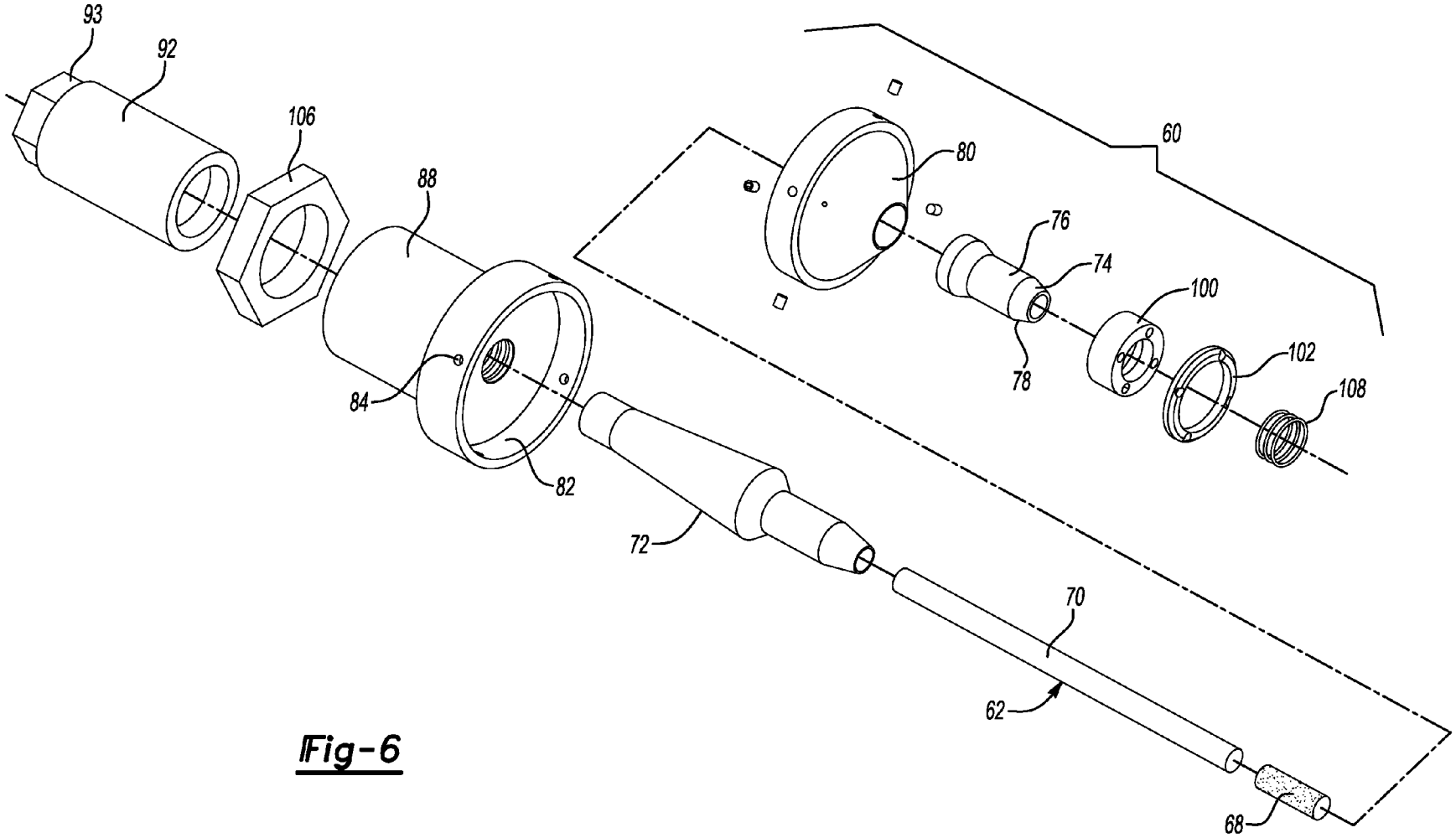
FIG. 6 is an exploded perspective view of the electrode assembly shown in FIG. 4.
Figure 7:
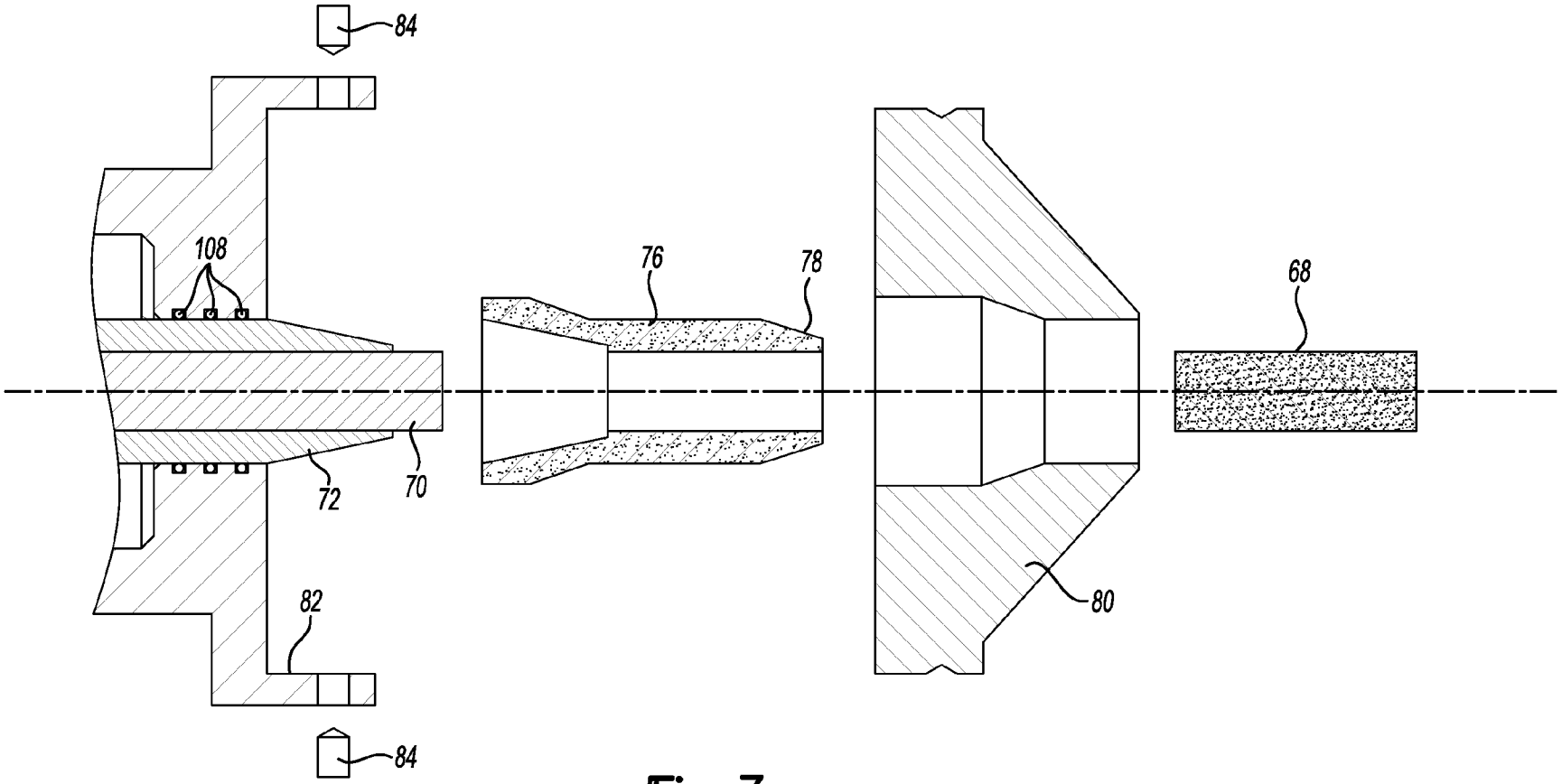
FIG. 7 is a fragmentary cross-sectional view of the embodiment of the electrode assembly shown in FIG. 4.

Referring to FIGS. 4-7, an alternative embodiment of the electrode assembly 60 is illustrated. An electrode rod 62 extends through the electrode assembly 60. The electrode assembly 60 is assembled to an EHF chamber wall 64 as best shown in FIG. 5. An opening 66 is defined by the EHF chamber wall 64 in which the electrode assembly 60 is assembled. A tip portion 68 of the electrode rod extends inside the EHF chamber wall 64. A main portion 70 of the electrode rod 62 is retained within an insulation sleeve 72. The tip portion 68 is preferably welded to the main portion 70 to form the electrode rod 62.

The insulation sleeve 72 includes an insulation tip cap 74. The insulation tip cap is a bevelled or frustoconical surface. A replaceable insulation tip 76 provides the insulation tip cap 74 and is assembled to the chamber end of the insulation sleeve 72. The replaceable insulation tip 76 may be replaced with the electrode tip or independently to provide renewed insulation between the electrode rod 62 and the EHF chamber. A deflection surface 78 is provided on the insulation tip cap. A conical insert 80 is assembled to a cup-shaped receptacle 82. Set screws 84 may be provided to secure the conical insert 80 within the cup-shaped receptacle 82. A holder receptacle 86 is defined within the adaptor 88 that provides the cup-shaped receptacle 82. A holder 92 is received within the holder receptacle 86 and may be adjusted by turning the holder with a wrench that engages the wrench flats 93.

A plurality of vent holes 94 may be provided within the conical insert 80 to allow entrapped gas to be vented from the electrode assembly 60. Any fluid that passes between the conical insert 80 and the insulation insert 76 may be collected within pockets 96 that are provided within the conical insert 80. Any fluid or gas pressure developed within the pockets 96 is vented through the vent holes 94.

As previously described with reference to FIGS. 1 and 2, a retainer 100 is assembled within the holder 92 to hold the insulation sleeve 72 within the holder 92. A lock ring 102 is then assembled over the retainer 100 to lock the retainer 100 in place. An adaptor nut 104 is attached to the adaptor 88 to secure the adaptor to the EHF chamber wall 64. A holder nut 106 is secured to the holder 92 to maintain the position of the holder 92 within the adaptor 88. A plurality of o-rings 108 may be provided to provide a seal between the insulation sleeve 72 and the adaptor 88.

Figure 8:
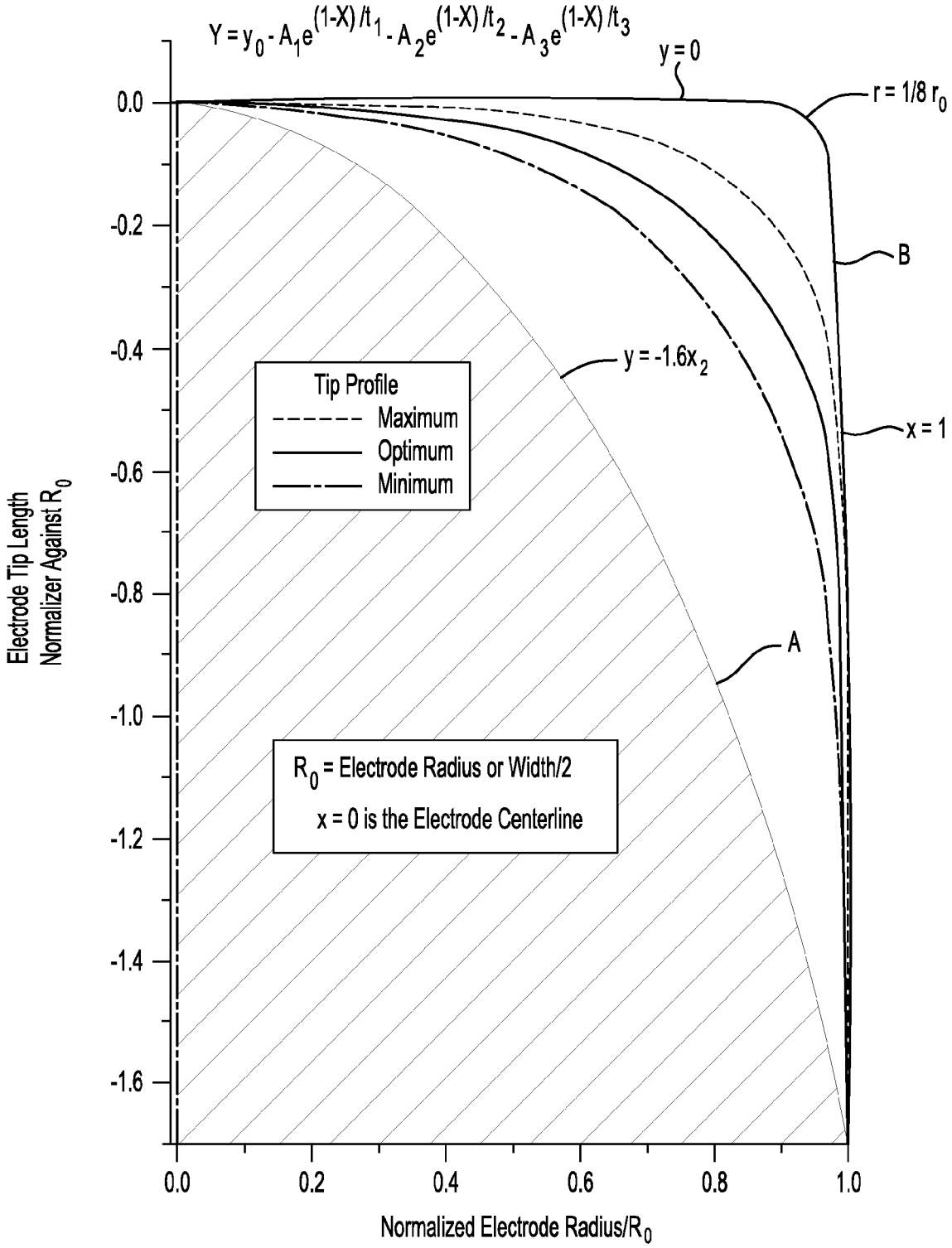
FIG. 8 is a graph of a tip profile for an electrode for use in an electro-hydraulic forming tool.

Referring to FIG. 8, a preferred shape or profile of an electrode tip may be used in either embodiment of the EHF forming tool described above or other pre-existing EHF forming tools. The preferred electrode tip profile is defined in FIG. 8. The design of an electrode tip is impacted by chamber volume, chamber geometry and discharge energy. Pressures at the electrodes have been estimated to be between 1-2 GPa. The electrode system must sustain erosive pressure and high temperature plasma while being submerged in a corrosive fluid such as water that may, if desired, include a rust inhibitor.

The electrode must also perform the functions of conducting energy into and out of the chamber, maintaining the electrode isolation from the chamber or a source of ground. The electrode assembly must also maintain the chamber's water tight seal while allowing for measurement and adjustment of the inter electrode gap. The electrode assembly also must constrain motion of the electrode during the pressure pulses that may tend to cause the electrode to be ejected from the EHF chamber.

The profile of the electrode or tip shape can influence the efficiency of the discharge and the voltage differential occurring during a discharge. Finally, the electrode profile can also affect the rate of erosion of the electrode. In some instances, severe tip erosion may be experienced by the electrode tip. Electrodes must be changed periodically during a production operation. The erosion rate substantially impacts the frequency of electrode replacement.

The tip profile shown in FIG. 8 is a relatively stable tip profile that provides a more consistent discharge than other electrode profiles. This stable tip profile minimizes erosion and reduces the increase of the resulting gap. If the gap between opposed electrodes is doubled, the voltage at the moment of discharge may decrease by 5% and the resulting current drop may be nearly 20%. The combined voltage and current loss results in nearly a quarter of the energy input being lost for forming purposes. Tips having a hemispherical profile typically have a gap increase of 5 mm over a 120 discharges. Studies of initially flat electrode tips provide a gap increase of 2 mm over 120 discharges. As a result, it may be necessary to advance the electrode after each 100 discharges.

Electrode tips having a pointed or conical cross section tend to focus the discharge energy and erode very quickly to rapidly lose their original design and shape. Flat electrode tips erode more slowly, however, their profile tends to change over time as discharges occur. Electrode tip profiles gradually change during the erosion process with a variable rate of erosion and constantly changing discharge conditions. It is proposed that a stable tip profile be provided initially that has a generally flat tip and rounded edges which asymptotically approach the desired stable electrode tip profile. Such a tip profile tends to exhibit the slowest rate of erosion and is more stable over time.

As shown in FIG. 8, an electrode tip is shown in half-section. The solid optimum line shows the tip in the optimum shape. The x and y axes are normalized against the overall electrode half-diameter/width. The optimum profile shown in the solid line represents the nominal shape of the proposed electrode. The maximum and minimum profiles shown in FIG. 8 describe the operating envelope of stable tip shapes. The optimum, maximum and minimum profiles may be described by the following exponential decay equation:

$$y(x)=y_o-A_1e^{(1-x)/t1}-A_2e^{(1-x)/t2}-A_3e^{(1-x)/t3}$$

where e is the base of the natural logarithms (2.718 . . . ), and the constants to be used in the equation describing each profile are found in Table 1 below:

| | $y_o$ | $A_1$ | $t_1$ | $A_2$ | $t_2$ | $A_3$ | $t_3$ |
|---|---|---|---|---|---|---|---|
| Maximum | 0.00048 | 0.40939 | 0.14818 | 0.72452 | 0.01097 | 0.38186 | 0.00026 |
| Optimum | 0.0038865 | 0.59789 | 0.19858 | 0.71285 | 0.01263 | 0.19676 | 0.00065 |
| Minimum | 0.01164 | 0.80809 | 0.23584 | 0.83625 | 0.01788 | 1.61654 | 0.00031 |

The benefit of an improved tip shape may also be obtained in large measure by providing a tip with a profile that is between lines A and B in FIG. 8. The tip is larger than line A that is defined by:

$$Y=-1.6x^2$$

And that is smaller than a polyline identified by B and defined by the horizontal line (y=0) and the vertical line (x=1) with a radius of $\frac{1}{8}R_0$.

Where:

y is the electrode tip length, as measured from the end of the tip;

x is the distance from electrode centerline; and $R_0$ is the electrode radius equal to half of the diameter of the electrode diameter or half of the width of the electrode.

Although embodiments of the invention have been disclosed, it will be apparent to persons skilled in the art that modifications may be made without departing from the scope of the invention. All such modifications and equivalents thereof are intended to be defined by the following claims.

What is claimed:

1. An electrode assembly comprising:

an electrode rod in an electro-hydraulic forming tool that has a chamber;

an insulation sleeve assembled over the electrode rod, the insulation sleeve having an inner end that is closer to the chamber than an outer end;

an adaptor disposed about the insulation sleeve that secures the electrode and the insulation sleeve in an opening defined by the chamber;

a conical receptacle assembled to the adaptor that defines an opening;

a replaceable insulator tip that is assembled within the opening in the conical receptacle and extends through the opening in the conical receptacle, wherein the inner end of the insulation sleeve is received within the insulator tip, and wherein the conical receptacle retains the insulator tip when the electrode assembly is discharged and the conical receptacle is removed from the adaptor to replace the insulator tip.

2. The electrode assembly of claim 1 wherein the adaptor defines a cup-shaped end that is disposed within the chamber, and wherein the conical receptacle is at least partially received in the cup-shaped end of the adaptor.

3. The electrode assembly of claim 1 further comprising a holder that receives the electrode and the insulation sleeve, a retainer that is attached to the holder to secure the insulation sleeve and the electrode rod within the holder, and a lock ring that locks the retainer to the holder.

4. An electrode assembly comprising:

an electrode rod in an electro-hydraulic forming tool having a chamber, the electrode rod extending from outside to inside the chamber and having a main portion and a tip portion;

an insulation sleeve assembled over the electrode rod, the insulation sleeve having a chamber end and a connector end, the chamber end is closer to the chamber than the connector end;

a holder attaches the electrode rod and the insulation sleeve to the chamber; and a replaceable insulator tip assembled to the chamber end of the insulation sleeve, wherein the chamber end of the insulation sleeve is received within the insulator tip.

5. The electrode assembly of claim 4 wherein the tip portion is formed of a different material than the main portion of the electrode rod and wherein the tip portion is welded to the main portion.

6. The electrode assembly of claim 4 wherein the tip portion is selected from the group consisting essentially of mild steel, tungsten, molybdenum or a tungsten-copper alloy.

7. The electrode assembly of claim 4 wherein the main portion is selected from the group consisting essentially of low carbon steel.

8. The electrode assembly of claim 4 wherein the tip portion is formed with a tip having a tip profile that has a flat tip and rounded edges that conform to the shape of the electrode after a substantial number of pulses.

9. The electrode assembly of claim 4 wherein the tip portion is formed with a profile described by the following equation:

$$y(x)=y_o-A_1e^{(1-x)/t1}-A_2e^{(1-x)/t2}-A_3e^{(1-x)/t3},$$

wherein e=a base of natural logarithms (2.718 . . . )

and constants used to define tip geometry are

| | $y_o$ | $A_1$ | $t_1$ | $A_2$ | $t_2$ | $A_3$ | $t_3$ |
|---|---|---|---|---|---|---|---|
| Maximum | 0.00048 | 0.40939 | 0.14818 | 0.72452 | 0.01097 | 0.38186 | 0.00026 |
| Optimum | 0.0038865 | 0.59789 | 0.19858 | 0.71285 | 0.01263 | 0.19676 | 0.00065 |
| Minimum | 0.01164 | 0.80809 | 0.23584 | 0.83625 | 0.01788 | 1.61654 | 0.00031 |

wherein the tip portion is formed with a profile that is larger than:

$$Y=-1.6x^2$$

and that is smaller than a polyline defined by the horizontal line (y=0) and the vertical line (x=1) with a radius of $\frac{1}{8}R_0$ where:

y is an electrode tip length, as measured form an end of the electrode tip;

x is a distance from an electrode centerline;

$R_0$ is an electrode radius equal to half of a width of the electrode; and

A and t are constants.

10. The electrode assembly of claim 1 wherein a deflection surface is provided at the inner end of the insulation sleeve that forms a tapered surface between a chamber end of the electrode rod and the chamber, wherein the deflection surface is narrowest by the electrode to deflect the force of a discharge of the electro-hydraulic forming tool.

11. The electrode assembly of claim 10, wherein the deflection surface is formed on a metal cap that is assembled over the electrode rod and axially between the inner end of the electrode sleeve and the chamber end of the electrode rod.

* * * * *